United States Patent [19]

Steinberg

[11] 4,321,709

[45] Mar. 30, 1982

[54] DECORATIVE SCARF

[76] Inventor: Ray Steinberg, 2631 E. West Hwy., Chevy Chase, Md. 20015

[21] Appl. No.: 224,837

[22] Filed: Jan. 13, 1981

[51] Int. Cl.[3] ..... A42B 5/00

[52] U.S. Cl. ..... 2/207; 2/91

[58] Field of Search ..... 2/207, 203, 91

[56] References Cited

U.S. PATENT DOCUMENTS

| | | | |
|---|---|---|---|
| 2,050,170 | 4/1936 | Fortune | 2/91 |
| 2,413,319 | 12/1946 | Golfieri | 2/207 |
| 2,462,727 | 2/1949 | Danelz | 2/91 |
| 2,479,731 | 8/1949 | Dibrell | 2/207 |
| 2,704,368 | 3/1955 | Swartz | 2/91 |

*Primary Examiner*—Doris L. Troutman

[57] ABSTRACT

A decorative scarf for a dress or blouse having an elongated neck portion with one end provided with a narrow tubular opening and, the other end provided with a wider rectangular section which in use is passed through said tubular opening to form a decorative wide tie or a simulated rosette.

3 Claims, 4 Drawing Figures

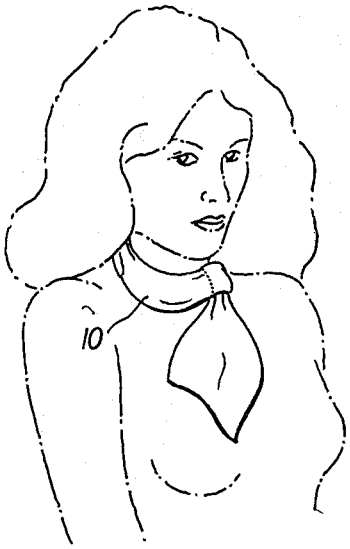
FIG. 1
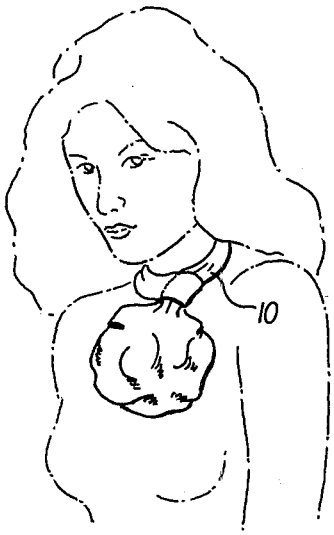
FIG. 2
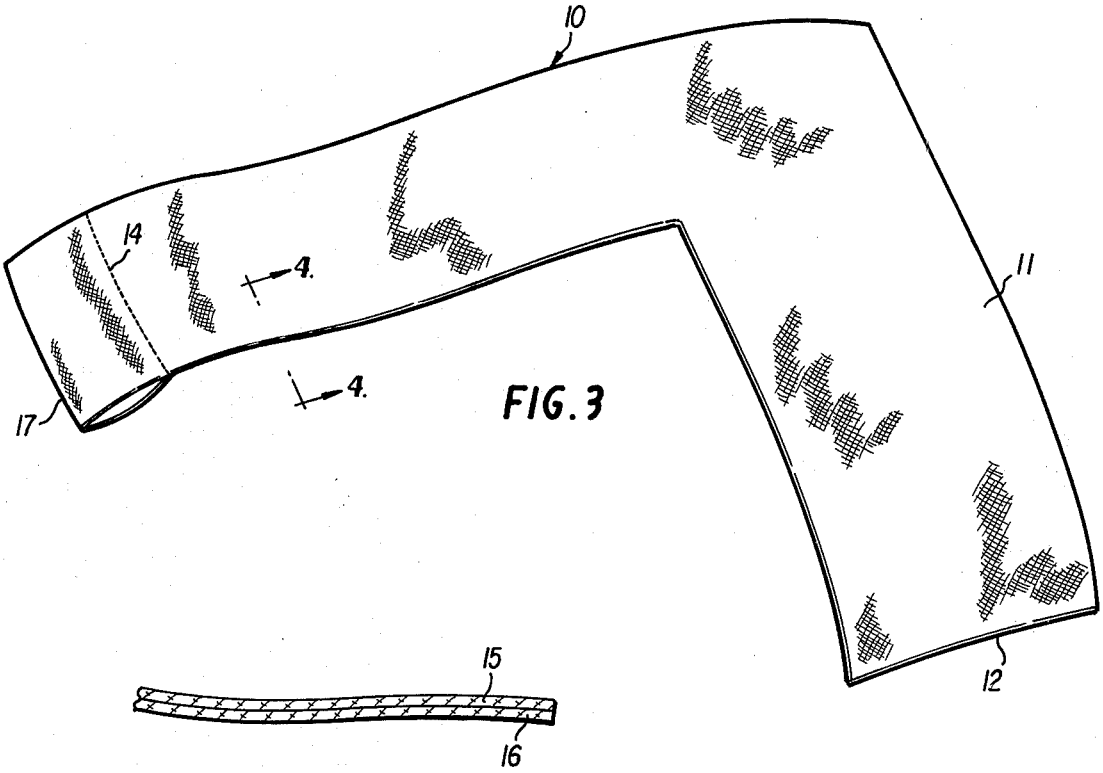
FIG. 3
FIG. 4

DECORATIVE SCARF

This invention relates to scarves and more particularly to scarves suitable for use by the wearer about the throat and to provide the wearer with an ornamental simulated flower or tie when properly arranged by the wearer.

Heretofore, various scarves have been proposed but all of these are made with a set pattern of color which when knotted about the throat of the wearer have loose ends that are permitted to hang loose or tucked under the body of the scarf without permitting the wearer to provide a pleasing ornamental decorative rosette or tie as is possible with the structure of the scarf of the instant invention.

It is accordingly an object of the present invention to provide a neck scarf which may be adopted by the wearer to provide a pleasing and decorative rosette or tie which can be individually fashioned by each wearer.

Another object is to eliminate the unsightly ends when the scarf is medially knotted.

Other and further objects of the present invention will appear from the following description.

Illustrative embodiments of my invention are shown in the accompanying drawing and are described for the purpose of illustrating this invention. These embodiments should in no way be construed as defining or limiting my invention and reference should be had to the appended claims for this purpose.

In the accompanying drawing in which like reference characters indicate like parts:

FIG. 1 illustrates one embodiment of my invention shown in use about the neck of the wearer as a tie;

FIG. 2 shows a second embodiment in which the ornament simulates a rosette;

FIG. 3 is a plan view of the FIG. 1 scarf in flattened position before use; and FIG. 4 is a cross-section of FIG. 3 showing the 2 ply structure of the scarf.

Referring to FIG. 3, the scarf is made up of a length of suitable preferably colored and patterned material which is composed of 2 plies 15 and 16 as shown in FIG. 4, and shaped in the form of an elongated section 10 having a seam sewn at end 14 to provide a tube opening. The elongated section is as long as is required to encompass the neck area. In the scarf, the boundaries are first sewn to connect the two plies, leaving end 17 open so that the material may be pulled therethrough to invert the seams. Then, seam 14 at the end of section 10 is sewn to provide a tube opening. In use, the scarf 10 is placed around the neck of the wearer. Corner end 12 is then threaded through the tube end 14 and pulled tightly around the neck. Because, the fabric is two ply, the section 11 can, after being pulled through the tube 14, be fashioned by the wearer to simulate a tie or "Dickie" shape as in FIG. 1 or a simulated rosette as in FIG. 2.

It will now be apparent that by the present invention, I have provided a novel scarf which may be utilized to ornament a blouse or a dress with an ornamented design similar to a "Dickie" such as a broad decorative tie or a simulated rosette. As a matter of fact, there are innumerable shapes that the wearer can fashion to serve as a decorative addition to a dress or a blouse.

Changes or modifications of the above described illustrative embodiment of my invention may be now suggested to those skilled in the art without departing from my inventive concept.

What is claimed is:

1. In a scarf made of 2 ply decorative material, comprising two rectangular portions positioned at right angle to each other, the first portion being narrower than the second portion, an end portion of said first portion is overlapped upon itself and stitched to form a narrow rectangular tubular section wherein said second portion is threaded through said tubular portion to be fastened around the neck of a wearer in a ornamental design.

2. The structure of claim 1 wherein the ornamental design is in the form of a wide tie.

3. The structure of claim 1 wherein the ornamental design is a simulated rosette.

* * * * *